US007469798B1

(12) United States Patent
Miller

(10) Patent No.: US 7,469,798 B1
(45) Date of Patent: Dec. 30, 2008

(54) WHEELED REFUSE CONTAINER

(76) Inventor: David H. Miller, 1301 S. Orlando Ave., Suite B, Cocoa Beach, FL (US) 32931

( * ) Notice: Subject to any disclaimer, the term of this patent is extended or adjusted under 35 U.S.C. 154(b) by 0 days.

(21) Appl. No.: 11/522,212

(22) Filed: Sep. 15, 2006

Related U.S. Application Data

(62) Division of application No. 10/646,480, filed on Aug. 23, 2003, now Pat. No. 7,185,783.

(60) Provisional application No. 60/405,452, filed on Aug. 23, 2002.

(51) Int. Cl.
*B65D 21/00* (2006.01)

(52) U.S. Cl. ..... 220/675; 220/771; 220/908

(58) Field of Classification Search ..... 220/671, 220/675, 735, 771, 908; 15/257.1, 257.2; D32/74

See application file for complete search history.

(56) References Cited

U.S. PATENT DOCUMENTS

| | | | | |
|---|---|---|---|---|
| 341,175 | A | 5/1886 | Shaw | |
| 686,954 | A | 11/1901 | Riley | |
| 1,170,797 | A | 2/1916 | Burroughs | |
| 1,212,305 | A | 1/1917 | Worsell | |
| 1,847,476 | A | 3/1932 | Fuhr | |
| 3,170,183 | A | 2/1965 | Leatherman | 15/257.1 |
| 3,390,804 | A | 7/1968 | Morgan | 220/32 |
| 4,600,113 | A * | 7/1986 | DeMars | 220/212 |
| 4,836,394 | A | 6/1989 | Glomski | 220/811 |
| D309,401 | S * | 7/1990 | Lombardi | D7/507 |
| 5,088,531 | A | 2/1992 | Wade | 141/108 |
| 5,092,463 | A * | 3/1992 | Dees | 206/373 |
| D345,837 | S * | 4/1994 | Bean | D34/5 |
| D355,514 | S * | 2/1995 | Breen | D34/1 |
| 5,535,913 | A | 7/1996 | Asbach et al. | 220/495.08 |
| 5,547,104 | A * | 8/1996 | Parker | 220/772 |
| 5,560,512 | A | 10/1996 | Hahn | 220/810 |
| D376,235 | S * | 12/1996 | Presnell | D34/1 |
| 5,611,450 | A | 3/1997 | DeMars | 220/212 |
| 5,624,050 | A | 4/1997 | Haas | 220/4.05 |
| 5,758,888 | A | 6/1998 | Burgan et al. | 280/47.34 |
| 5,785,369 | A | 7/1998 | Ridley, Sr. et al. | 294/1.1 |
| 6,244,458 | B1 | 6/2001 | Frysinger et al. | 220/592.09 |
| 6,318,588 | B1 | 11/2001 | Lichtenwalner | 220/908.3 |
| 6,390,495 | B1 | 5/2002 | Cates | 282/652 |

(Continued)

*Primary Examiner*—Anthony D Stashick
*Assistant Examiner*—Harry A Grosso
(74) *Attorney, Agent, or Firm*—Brian S. Steinberger; Law Offices of Brian S. Steinberger, P.A.

(57) ABSTRACT

Outdoor and indoor debris receptacles that can be formed from molded plastic. The receptacles include an open upper end with a D-shaped configuration and a closed bottom end with a substantially circular bottom configuration. The receptacles can have a generally cylindrical shape and a flat side wall having a triangular tubular shape for allowing the receptacle to be laid on its side so that rakes and brooms can move debris fully into the D-shaped opening with ease. At least one handle located on the apex of the D-shaped opening allows the container to be easily lifted to a vertical standing position, and curved interior wall surfaces allow debris to easily slide toward the bottom of the container. Embodiments allow for different sizes of container, and extras such as lids, wheels and supports for tools, such as but not limited to rakes, hoes, and shovels to be carried and stored by the receptacles.

16 Claims, 17 Drawing Sheets

U.S. PATENT DOCUMENTS

| | | | | |
|---|---|---|---|---|
| 6,520,554 | B2 | 2/2003 | Ditzik | 294/1.1 |
| 6,698,058 | B2 | 3/2004 | Cann | 15/257.1 |
| 7,185,783 | B1 * | 3/2007 | Miller | 220/675 |
| 2001/0045371 | A1 | 11/2001 | Ordonez | 206/499 |
| 2002/0003144 | A1 | 1/2002 | Grimes | 220/625 |
| 2004/0020928 | A1 | 2/2004 | Lin | 220/263 |

* cited by examiner

Fig. 19B
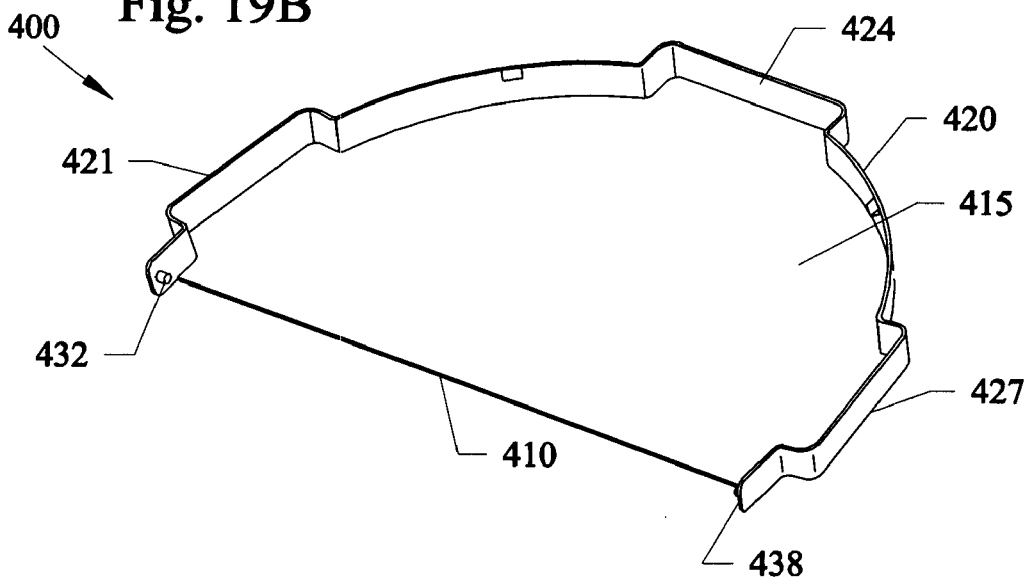
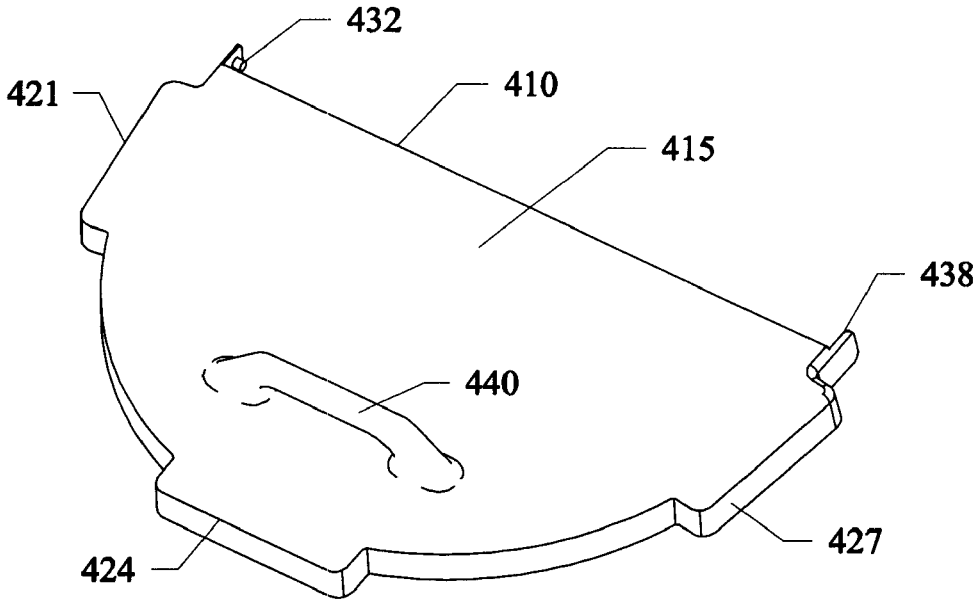
Fig. 19A

Fig. 22B
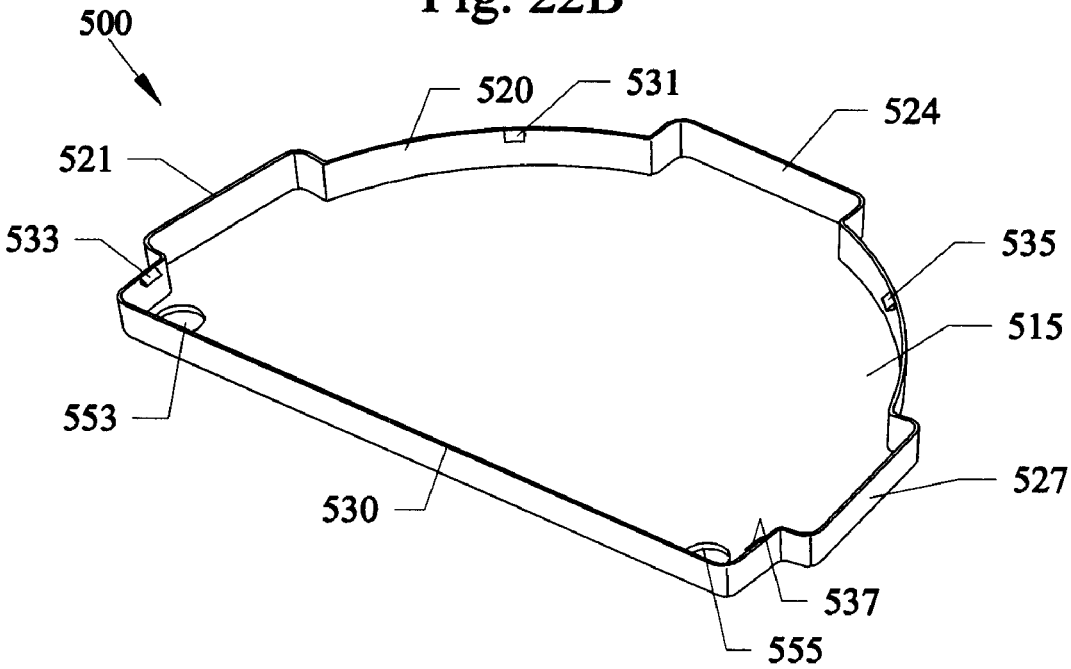
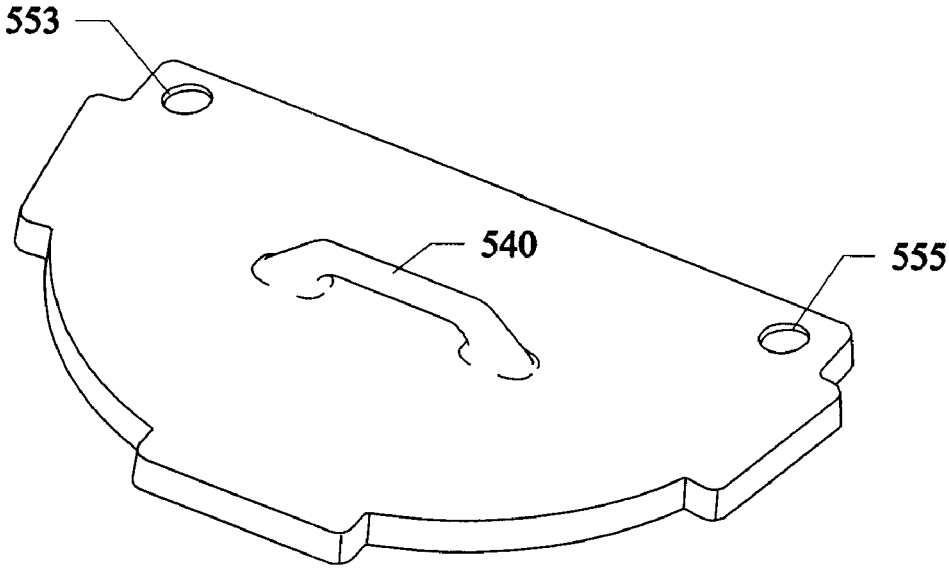
Fig. 22A

WHEELED REFUSE CONTAINER

This invention is a Divisional of application Ser. No. 10/646,480 filed Aug. 23, 2003, now U.S. Pat. No. 7,185,783, which claims benefit of U.S. provisional application 60/405,452 filed Aug. 23, 2002.

FIELD OF INVENTION

This invention relates to outdoor refuse containers, and in particular to novel refuse containers and methods of use where the container can be easily laid on flat side portions so that debris can be completely swept inside the container, and remain stable and sturdy when full and standing upright.

BACKGROUND AND PRIOR ART

It is common to use refuse containers such as plastic tubular cans for holding outdoor refuse such as leaves, branches, garbage, and the like. Typically, these containers must be kept in an upright standing position to be used. However, the upright standing position generally requires the user having to physically bend and pickup the refuse with one's hands to place it into the standing container. In addition to the undesirable physical movements, it is usually undesirable to physically touch the refuse even if one uses gloves. Furthermore, physically lifting up and moving the refuse usually results in some debris dropping out and having to be picked up again. Users have also been known to try and lay the tubular containers on their sides. However, the circular opening to the container makes it difficult and near impossible to sweep, rake, and move the refuse into the container. Users have also tried to place their body weight with a foot on the upper facing side of the container to squash the container. However, the circular opening is not meant to bend, and also, the user can slip, fall and get hurt trying to stand on the sides of a plastic container.

Over the years various types of containers have been proposed for storing waste that is different from tubular containers. See for example, U.S. Pat. No. 341,175 to Shaw; U.S. Pat. No. 6,86,954 to Riley; U.S. Pat. No. 1,212,305 to Worsell; U.S. Pat. No. 1,170,797 to Burroughs; U.S. Pat. No. 1,847,476 to Fuhr; U.S. Pat. No. 3,170,183 to Leatherman; U.S. Pat. No. 3,390,804 to Morgan; U.S. Pat. No. 5,088,531 to Wade; U.S. Pat. No. 5,758,888 to Burgan et al; U.S. Pat. No. 5,785,369 to Ridley et al.; U.S. Pat. No. 6,318,588 to Lichtenwalner; U.S. Pat. No. 6,390,495 to Cates; and Des. 376,325 to Presnell.

Shaw '175, Riley '954, Worsell '305, Burroughs '797, and Morgan '804 each show containers having substantially D-shaped outer wall shapes for handling debris. However, these containers have their opening ends having at least and preferably larger interior diameter sized spacing than their closed ends, which makes the containers difficult if not impossible to stand on their closed bottom ends. Furthermore, filling these containers with debris creates an unstable container since the interior weight is concentrated toward the upper open ends and would tend to cause the containers to fall over spilling their contents out. Furthermore, all of these containers must be physically lifted and carried to be moved which makes them difficult when filled to be mobile. In addition, Riley, 954, Burroughs '797 and Morgan '804 has pivotal lids that would have to be physically removed in order to effectively push debris into those containers.

Leatherman '183, Fuhr '476, Wade '531, Lichtenwalner '588 and Cates '495 each describe debris container having side walls forming rectangular shapes that also have their open ends be larger in interior cross-section than their closed bottom interior ends so that filling up the containers causes a stability problem when trying to vertically stand the container up since more weight is adjacent the upper open end than the closed end. These containers would also tend to fall over and spill their contents out.

Presnell '235 and Burgan '888 describe cylindrical containers having rectangular flat side walls, and similar to Lichtenwalner '588 have larger sized upper open ends than the closed bottom ends. The containers are not very stable when filled with debris and can easily tip over and spill the container contents when being used. Further, Presnell '235 and Burgan '888 only have handles on left and right sides of the containers which make it difficult to lift from horizontal to standing positions and vice versa. Also, both containers have raised rectangular shaped lip edges adjacent their upper open ends making it difficult to push debris over the bump like edges into the containers. Additionally, the small flat mouth edges of these references are much too small to allow traditional 24 inch wide brooms and rakes enough space to effectively sweep debris into the containers. Still furthermore, only Burgan '888 allows for a separate dolly to make their container more mobile. However, this separate dolly would add unnecessary space, assembly, and expose requirements in order to be effectively used.

Ridley et al. '369 describes a debris collection apparatus that attaches a scoop to a garbage bag that cannot be moved from a horizontal position to a vertical position since it requires the user to physically lift and separate the scoop from the bag in order place the bag in another cylindrical refuse container. Thus, Riley must be used with other containers to be used.

None of the containers of the prior art allow for the user to easily lift and lower the containers from horizontal to vertical positions and vice versa, solely by using easily reachable handles. The prior art containers generally require the user have to physically lift the container itself about their side walls and/or upper open end edges which makes moving the containers difficult and uncomfortable.

The containers of the prior art are difficult to carry over one's shoulder and back. Completely cylindrical containers tend to wobble and roll and are difficult to hold in place over one's shoulder and back when using one hand. Rectangular shaped containers are uncomfortable when placed over the shoulder and back and cannot be adequately supported by one hand.

The prior art containers when laid on their sides tend to wobble and roll and do not generally remain flush against the ground. Also, when stored, the prior art containers generally cannot be placed flush against walls in storage rooms, garages and the like. Thus, the prior art containers waste space since they cannot be placed flush against walls during storage. None of the refuse containers described above that can lie on their sides can be formed from a single mold, and instead would be expensive and undesirable to manufacture.

The prior art containers generally have a high center of gravity so that when filled the containers are unsteady, tend to wobble and can fall over. None of the containers allow for a both a strong and slopping lip edge to allow debris to be easily slid into the container. Also, none of the containers combine both a wide flat edge large enough to handle 24 inch brooms and rakes while having enough mouth height on the containers to allow one to move substantial amounts of debris into the containers in one sweep.

In addition to the other problems with prior art, users must physically carry long handled garden tools such as rakes, hoes and shovels when using these containers. Leatherman shows a clip that loosely holds a portion of a garden tool handle. However, long handled tools can easily clip out of the clip, and/or the clip can easily break off. Thus, none of these references allow for attaching, storing and carrying tools such as rakes and brooms with debris containers.

SUMMARY OF THE INVENTION

A primary objective of the invention is to provide a novel refuse container with a triangular-torpedo shaped flat side wall that allows the container to remain flush to a planar ground surface, and easily raised upright when needed.

A secondary objective of the invention is to provide a novel refuse container with flat side wall having three handles substantially perpendicular to one another so that the container can be easily moved from a standing position to a side position and vice versa solely using the handles.

A third objective of the invention is to provide a novel refuse container having different mouth shaped opening than the bottom closed position while allowing for a center of gravity for keeping the container in a stable upright position when filled.

A fourth objective of the invention is to provide a novel refuse container with flat side wall having a generally triangular-tubular outer shaped edge with gradually curving interior contour walls that allow for easy filling of the container while it is laid on its side.

A fifth objective of the invention is to provide a novel refuse container with a flat side edge that is large enough to receive a 24 inch rake or brush broom head so that all debris from the 24 inch rake or brush head can be swept into the container.

A sixth objective of the invention is to provide a novel refuse container having a flat upwardly sloping ramp inlet portion for allowing easy access to sweep debris into the container while having a blunt tip edge strong enough to withstand heavy use without tearing or breaking apart.

A seventh objective of the invention is to provide a novel refuse container with flat side wall for laying the container on its' side and having reinforced side walls for durability so that the container remains sturdy when vertically raised.

An eighth objective of the invention is to provide a novel refuse container with flat side wall having a completely removable lid cover that can easily snap over the open end of the container.

An ninth objective of the invention is to provide a novel refuse container with flat side wall having a completely removable lid cover that can easily attach onto and hinge over the open end of the container.

A tenth objective of the invention is to provide a novel refuse container with flat side wall with wheels mounted for easy mobility.

An eleventh objective of the invention is to provide a novel refuse container that can have molded holders for securely holding, storing and carrying handle tools such as rakes, hoes, brooms, and the like, to the outer side of the container.

A twelfth objective of this invention is to provide a novel refuse container that can have through-holes in a lid of the container to allow the handles on tools such as rakes, hoes, shovels, and brooms, to be inserted, supported and carried by the container.

A thirteenth objective of the invention is to provide a novel refuse container that when filled can be comfortably supported over one's shoulder and back when moved and remains both steady and stable when held by one hand over one's shoulder and back.

A fourteenth objective of the invention is to provide a novel refuse container that can easily lay flush against a wall surface when not being used and not taking up unnecessary space for storage.

A sixteenth objective of the invention is to provide a novel refuse container that can directly lay flush against the ground and does not tend to wobble or roll when empty, or when being filled with debris.

A preferred embodiment of the refuse container can include a generally semi-tubular container formed from molded plastic having a closed bottom end having a substantially circular configuration and an open end having a substantially D-shaped configuration, the container can have rounded side walls with a non-rectangular shaped flat side wall portion on the container. The flat side wall can have a configuration that is triangular shaped, torpedo shaped, or a combination of triangular torpedo shaped. The containers can include at least one handle at an apex portion of the D-shaped open end location substantially midway from the non-rectangular shaped flat side wall portion for allowing the container to be physically moved from a standing upright position to a side oriented position with the container laying on the non-rectangular flat side wall so that the container can be filled with debris, and the handle can also allow the container to be easily moved back to the standing position.

Along a flat edge of the D-shaped opening can be an angled ramp for allowing debris to be easily swept into the container. The angled ramp can have a straight upwardly sloping planar ramp portion, and include a rounded blunt tip leading to the straight upwardly sloping planar ramp portion. The flat edge of the ramp can be approximately 24 inches long so that an approximately 24 inch wide broom head or approximately 24 inch wide rake head can easily slide and move all the debris being swept in each sweeping stroke into the mouth end of the container.

Inside of the container, the inner walls can have only non-sharp angled interior surfaces such as concave curved surfaces so that debris easily slides inside of the container towards the closed bottom end.

Embodiments of the invention can include three handles arranged around upper curved side portions of the container. For example, the containers can include a left handle on the upper curved side adjacent to a left side of the flat side wall portion, a right handle on the upper curved side substantially adjacent to a right side of the flat side wall portion, and a middle handle on the upper curved side substantially between the left side of the flat side wall portion and the right side of the flat side wall portion.

Molded plastic lids can be used with the containers such as a lid being hingedly attached onto the open end of the container to close off the open end of the container.

A wheeled embodiment can include at least one wheel snapably mountable and removable to the bottom of the container for allowing the container to be easily mobile.

Holder(s) can be molded onto an outer side wall of the container for allowing a handle of an implement to slide into the holder and be held in place parallel to and alongside of the container. The container can then carry implements such as but not limited to rakes, brooms, hoes, and shovels.

The tool implements can also be supported by opening(s) in a lid of the container so that handles to the tools can be inserted into the opening(s) and then carried by the container.

Novel methods for using the receptacle containers can include positioning the cylindrical container having a closed end and an open end into a horizontal side oriented position on a non-rectangular flat side exterior wall portion of the container, the open end having a substantially D-shaped opening with a flat side edge, and the closed end being substantially circular shaped. The next step can include sweeping debris by an approximately 24 inch wide tool head such as a 24 inch wide rake head or 24 inch broom head onto the flat side edge of the D-shaped opening wherein a single sweep moves all debris along the approximately 24 inch wide tool head into the open end of the container. The final step when sweeping has been completed can include lifting the container from the side-oriented position by a single handle positioned along an apex portion of the D-shaped opening to a vertically standing position, wherein the debris slides along interior curved contour walls of the container to move substantially toward the closed bottom end of the containers.

Further objects and advantages of this invention will be apparent from the following detailed description of the presently preferred embodiments which is illustrated schematically in the accompanying drawings.

BRIEF DESCRIPTION OF THE FIGURES

FIG. 19A is a top perspective view of a hinge lid for use with the container embodiments.

FIG. 19B is a bottom perspective view of the hinge lid of FIG. 19A.

FIG. 22A is a top perspective view of a novel snap lid with openings for supporting the handles of implements such as brooms, rakes and shovels.

FIG. 22B is a bottom perspective view of the lid with openings of FIG. 22A.

DESCRIPTION OF THE PREFERRED EMBODIMENTS

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

Figure 1:
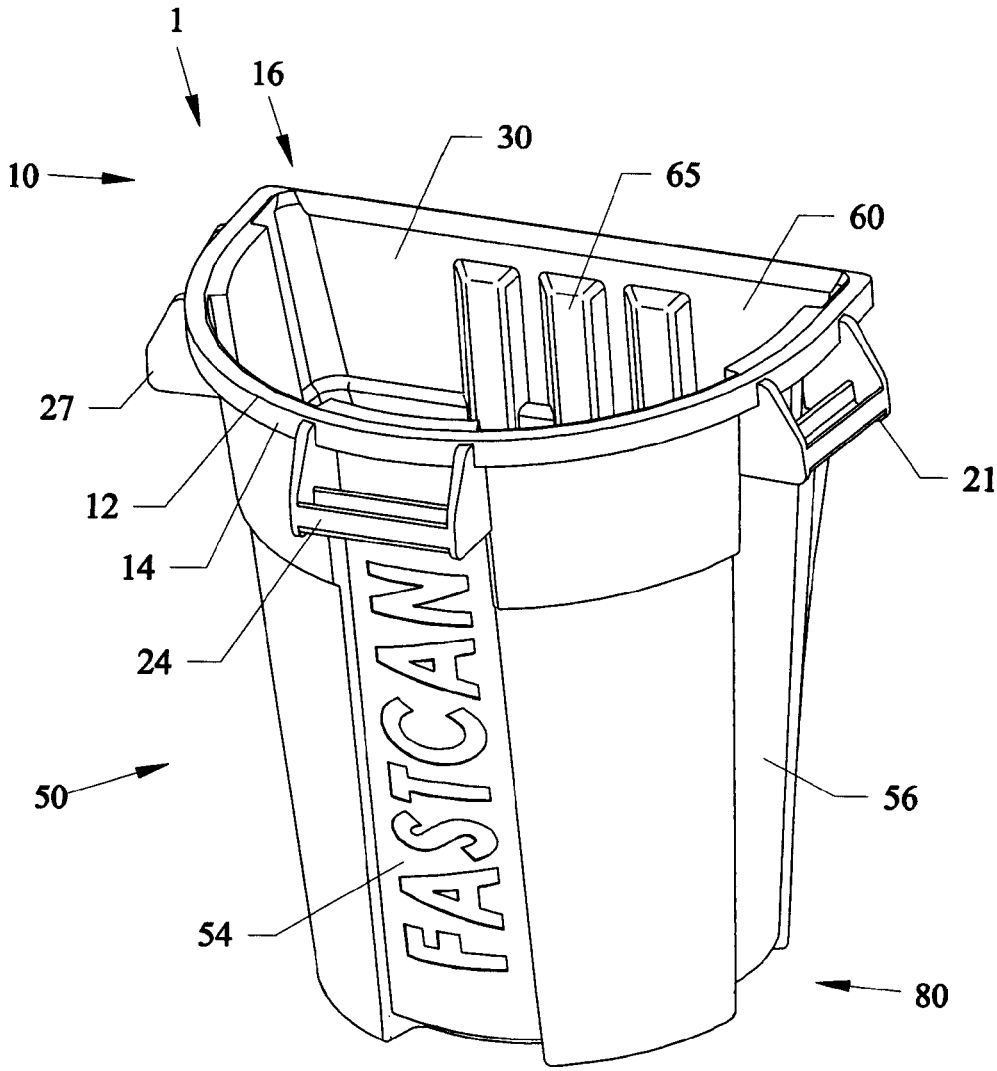
FIG. 1 is a front upper right perspective view of a first embodiment of the novel outdoor refuse container.
Figure 2:
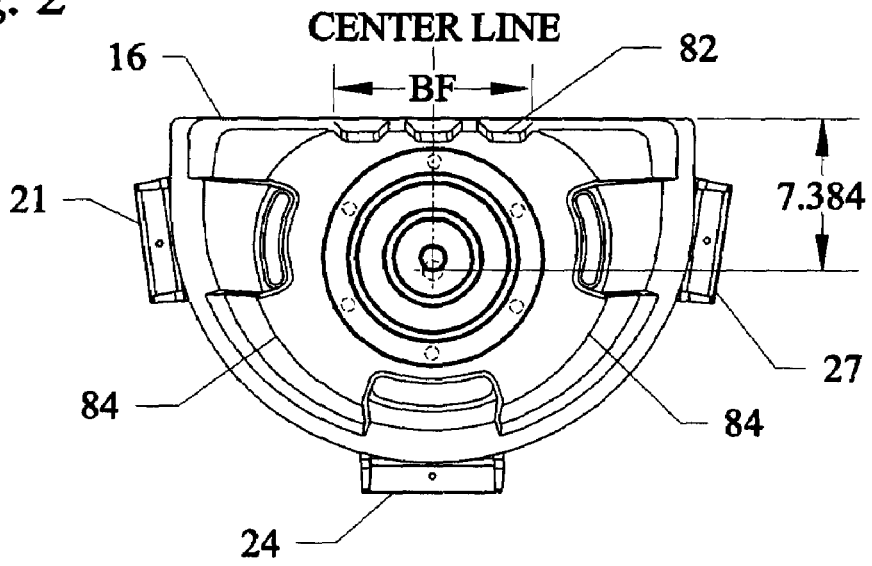
FIG. 2 is a bottom view of the embodiment of FIG. 1.
Figure 3:
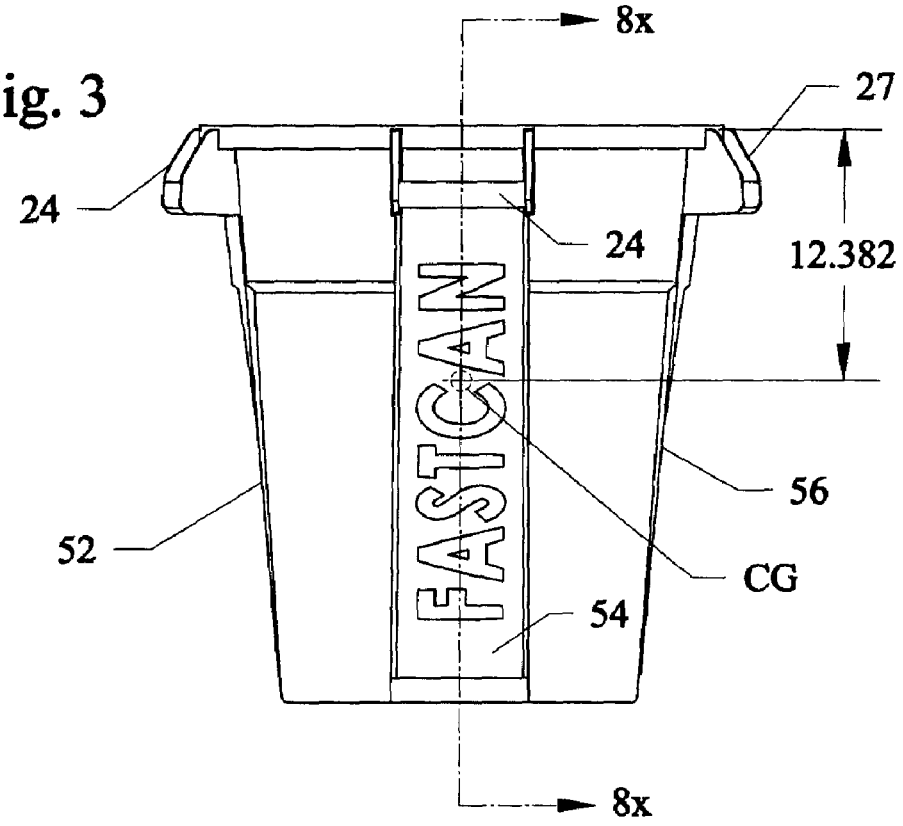
FIG. 3 is a front view of the embodiment of FIGS. 1-2.
Figure 4:
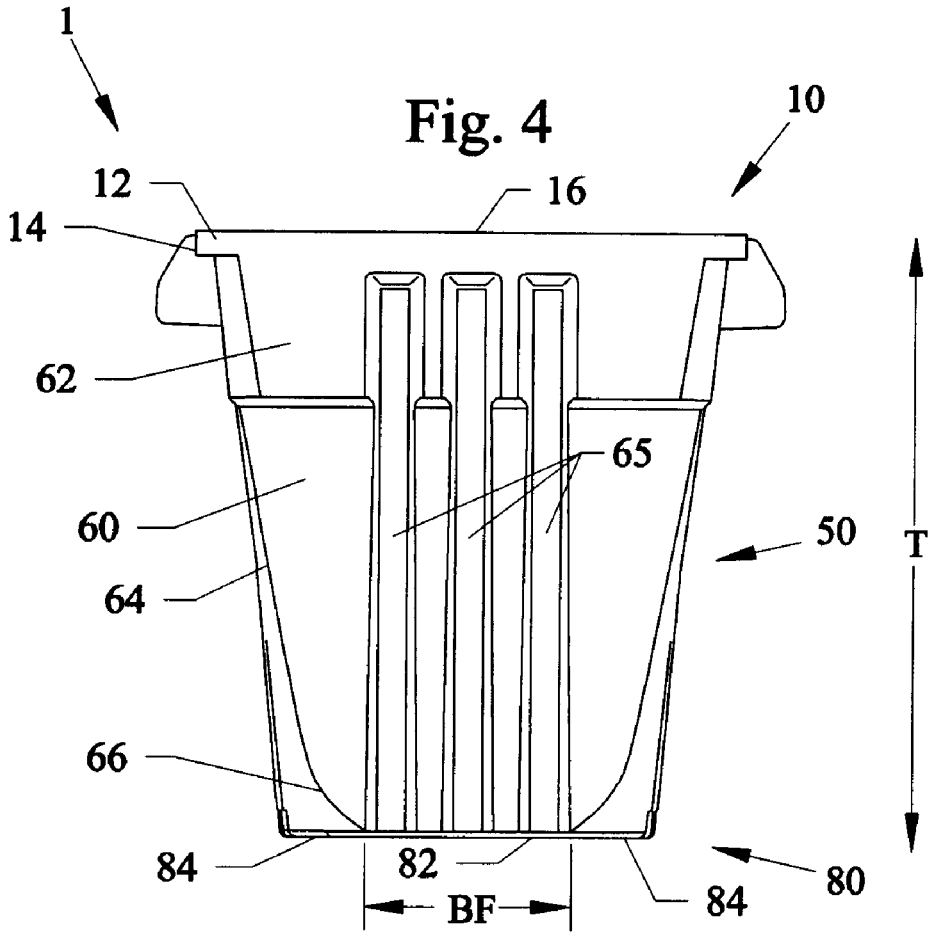
FIG. 4 is a rear view of the embodiment of FIGS. 1-3.
Figure 5:
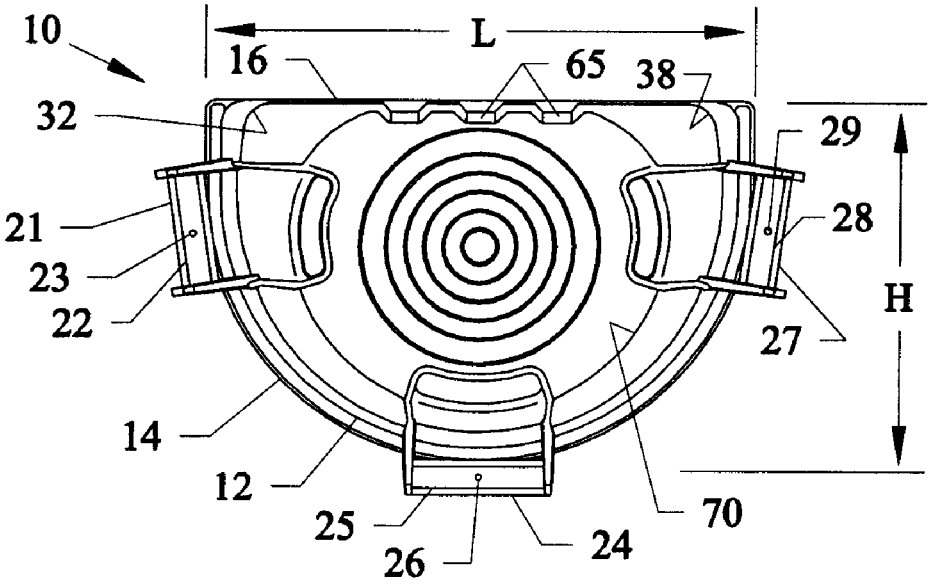
FIG. 5 is a top view of the embodiment of FIGS. 1-4.
Figure 6:
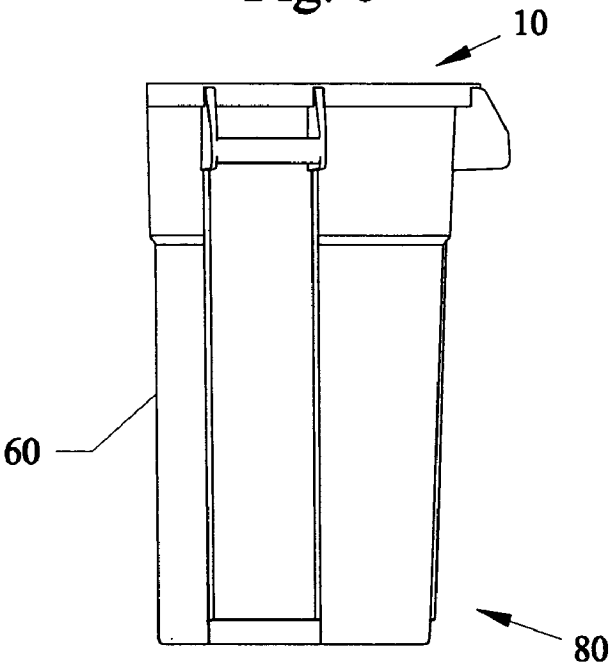
FIG. 6 is a side view of the embodiment of FIGS. 1-5.
Figure 7:
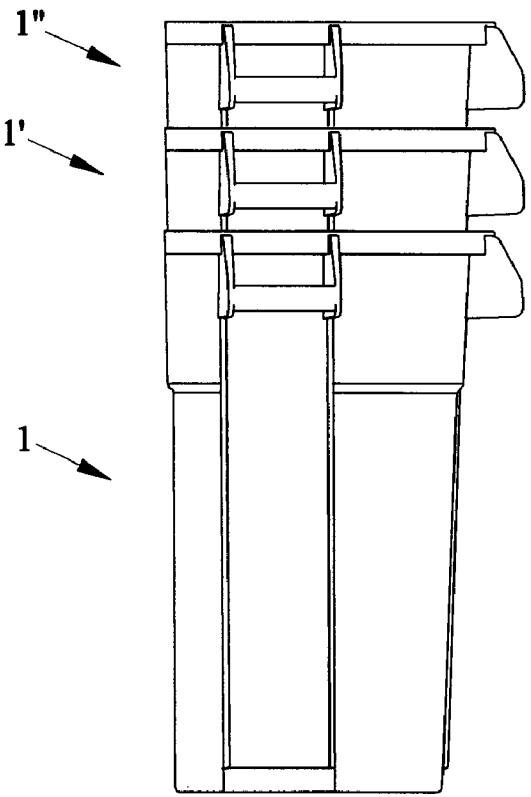
FIG. 7 is a side view of stacked containers of the first embodiment of the preceding figures.
Figure 8:
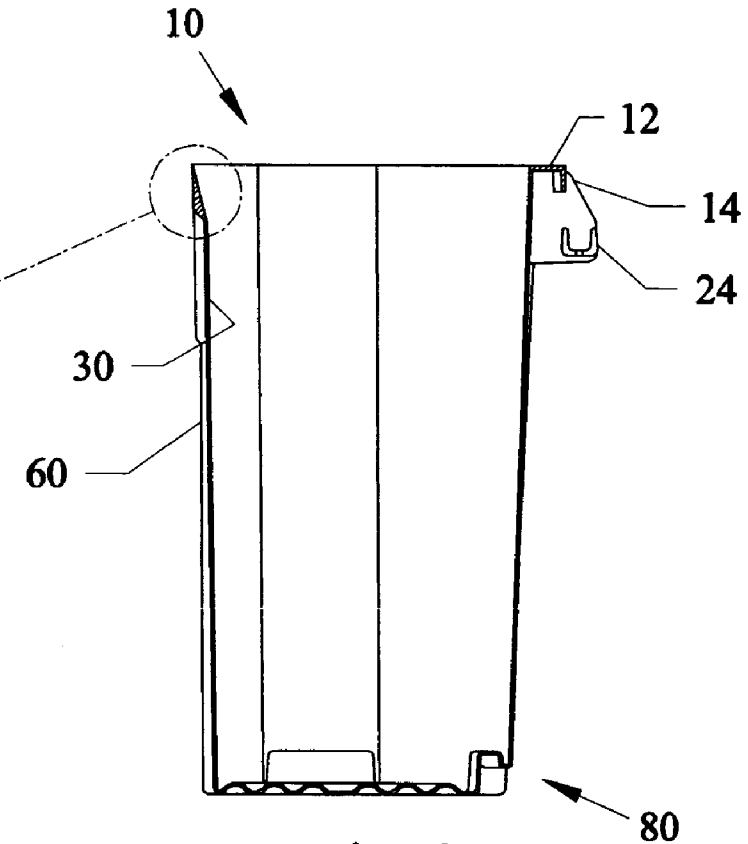
FIG. 8 is a cross-sectional view of the embodiment container of FIG. 3 along arrows 8X.
Figure 8A:
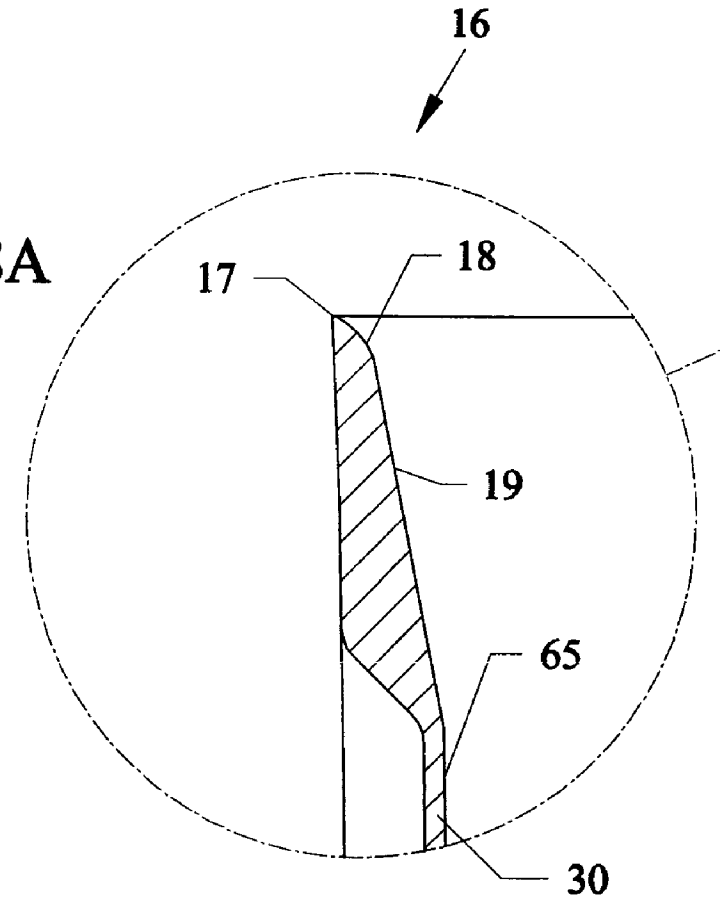
FIG. 8A is an enlarged view of the sloping scoop edge portion of the container of FIG. 8.

FIG. 1 is a front upper right perspective view of a first embodiment of the novel outdoor refuse container 1. FIG. 2 is a bottom view of the container 1 of FIG. 1 showing the substantially circular configuration bottom end 80. FIG. 3 is a front view of the container 1 of FIGS. 1-2. FIG. 4 is a rear view of the container 1 of FIGS. 1-3 showing the triangular-tubular shaped flat side wall portion 60. FIG. 5 is a top view of the container 1 of FIGS. 1-4. FIG. 6 is a side view of the container 1 of FIGS. 1-5. FIG. 7 is a side view of stacked containers 1, 1', 1". FIG. 8 is a cross-sectional view of the container 1 of FIG. 3 along arrows 8X. FIG. 8A is an enlarged view of the sloping scoop edge portion 16 with rounded blunt end and sloping ramp portion.

Referring to FIGS. 1-8A, a first embodiment container 1 can be formed in a single piece from injection molded plastic, and the like, and have an open upper end portion 10 that can include a substantially D-shaped cross-sectional configuration defining an exterior surface and interior wall surface with the D-shaped configuration being slightly larger than a half-circle of upper inside diameter of approximately 13 inches and outer diameter of approximately 14.5 inches. Container 1 includes a longitudinal middle portion 50 having a configuration that changes from the substantially D-shaped cross-sectional shaped upper end 10 to a substantially circular (approximately 75% to approximately 85% circular end portion 80 defining an exterior surface and interior wall surface. The bottom end 80 can include a substantially flat edge 82 having a length BF of approximately 10 inches, and curved sides forming a substantial circle shape having a diameter of approximately 17.5 inches.

The container 1 can have a tall length T of approximately 28 inches tall. The middle portion 50 can include a flat side 60 having a generally triangular and tubular shaped configuration starting with a wide base portion 62 adjacent flat edge 16 curved sides 64 to curved tip side portion 66 which ends at flat edge portion 82 on the bottom circular end portion 80 of the container. Thus, flat side 60 can be triangular-tubular shaped with a blunt tip end.

Referring to FIGS. 1, 2 and 5, and 8A, the flat edge 16 of container 1 can include curved outer edges 32 and 38 to both sides of the flat interior floor 30 so that refuse easily slides into container 1. The inside of the container 1 has curved substantially concave shaped surfaces which run to the bottom curved walls 70 of the container adjacent to the bottom end 80 of the container so that debris can be easily swept into the container and allowed to slide to bottom end 80. Preferably there are no sharp interior edges and corners that can trap debris therein. As previously described flat edge 16 on mouth end 10 of the container can be up to approximately 24 inches wide inside of the container 1 so as to easily allow an approximately 24 inch wide rake or broom head to be able to completely sweep an entire 24 inch long amount of debris into the container 1 while it is laying on its flat side 60.

Referring to FIGS. 1, 5, 8 and 8A, upper end 10 can include a flat lip edge 12 of approximately ½ inch to approximately ¾ inch wide and an overhang portion 14 of approximately 1 inch high, that run in a substantially slightly greater than half circle configuration about the upper end 10 of the container 1. Edge 12 and overhand 14 aid in reinforcement of the open mouth end 10 to the container 1. Mouth end 10 can have a flat side 16 having an inside open length L of approximately 23 & ⅝ inches, and a height opening H of approximately 17 & ⅜ inches.

Flat side 16 can have a blunt tip end 17 that can be approximately 1/20 of an inch thick, which leads to a rounded surface portion 18, which then leads to a sloping ramp portion 19 that gradually slopes upward into a thickness of up to approximately ¼ inch thick and then into the flat sidewall 30 inside of container 1. The shape and thickness of flat side 16 can aid in the stability of the container when both laid on its side for allowing debris to be swept therein, and also when the container is stood upright so that the container does not lose its' shape and remains sturdy when full. Flat sidewall 30 can be thinner than the thickness of the upper end of ramp portion 19.

Referring to FIGS. 1-8A, three handles 21, 24 and 27, can be molded onto the container 1 about the D-shaped mouth end 10 and extend up to approximately 3 & ½ inches below the mouth end 10 of the container. A left handle 21 can be located to the left of flat edge 16, with a right handle 27 to the right of the flat edge 16, and a middle handle 24 mounted on the top of the D-shaped curved portion 12, 14 of mouth end 10. Right handle 27 and left handle 21 can be located approximately 4 to approximately 6 inches from flat edge 16. Each of the handles 21, 24, 27 can include half cylindrical cup portions 22, 25, 28 with lower facing curved surfaces that allow users to easily wrap their hands under the handles 21, 24, 27, and small through-holes 23, 26 and 29 therethrough for allowing water to drain through and not collect in the cup portions 22, 25, 28 when the container is in an upright standing position. The handles 21, 24 and 27 allow the user to easily lift the container from horizontal to vertical positions and vice versa, as well as allow a single user to carry the container 1 without having to grip any sidewalls of the container itself.

Referring to FIGS. 1-8A, along the middle portion 50 of the container can be parallel rounded bottom indentations 65 running along the flat side 60 of the container that are substantially perpendicular to the mouth end 10 and the bottom end 80. Although three indentations 65 are shown, more or less can be used as needed to aid in reinforcing and strengthening the container 1 so that the container 1 keeps its' shape when standing or laying on its side and when either empty, being filled and completely filled. Unlike the prior art, the novel refuse container 1 can be placed flush against the ground and does not tend to wobble or roll when either empty or when being filled.

Along the curved wall surface of middle portion 50 can also be parallel flat bottomed indentation portions 52, 54, 56 each being substantially perpendicular to the mouth end 10 and bottom end 80 that are also used for reinforcing and strengthening the container 1 so that the container maintains its' shape when laid on its side, standing upright, and whether the container 1 is empty, being filled or completely filled. An engraved or molded on indicia label such as "FASTCAN" can be located inside one of more of the indentations 52, 54, and 56. The three reinforcement indentations 52, 54, and 56 can be located directly beneath the handles 21, 24 and 27 so that the user can have more room to position their hand closer to the sides of the container 1 when gripping the handles 21, 24 and 27.

Referring to FIGS. 2-3, a container 1 completely filled with debris can have a center of gravity CG approximately 12.382 inches from the mouth end 10 of the container and approximately 7.384 inches from the flat edge 16 inside of the container 1. The center of gravity CG is low enough that the container remains very stable when standing upright and cannot be easily tipped over. The low center of gravity CG allows for easier stacking of the containers 1 as shown in FIG. 7, where three containers 1, 1' and 1" are shown to be easily stackable within one another. The novel containers 1, 1', 1" can be easily placed against a wall inside a storage room, garage, and the like and remain flush against the wall without taking up any unnecessary space.

Figure 10:
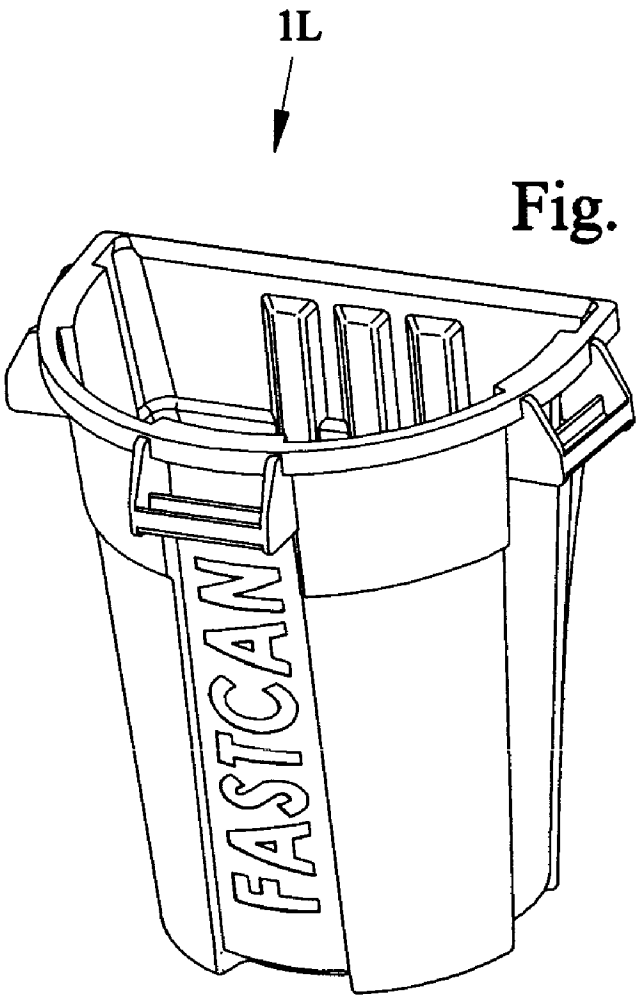
FIG. 10 is a perspective view of a 45 gallon container embodiment of the invention.
Figure 9:
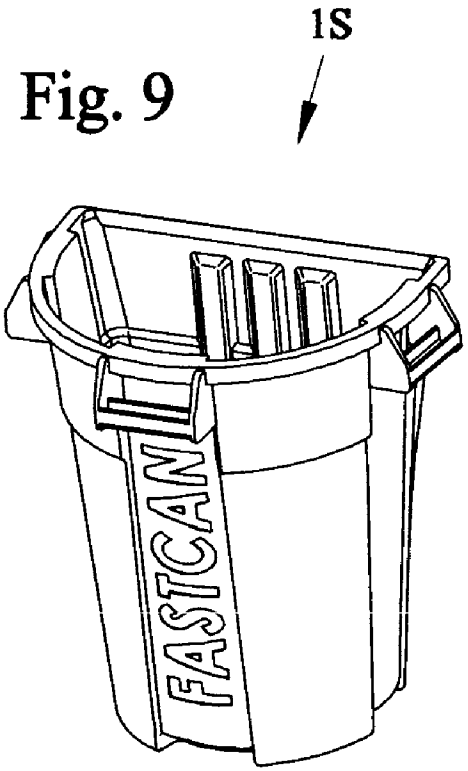
FIG. 9 is a perspective view of a 30 gallon container embodiment of the invention.

FIG. 9 is a perspective view of a container embodiment 1S of the invention that can be sized to hold approximately 30 gallons of debris therein. FIG. 10 is a perspective view of another container embodiment 1L of the invention that can be sized to hold approximately 45 gallons of debris therein. Both embodiments 1S and 1L can have similar novel shaped configurations as that described in the previous figures. As shown by FIGS. 9 and 10, the novel invention can be sized to include approximately 30 gallon trash bags as well as approximately 45 gallon trash bags.

Figure 11:
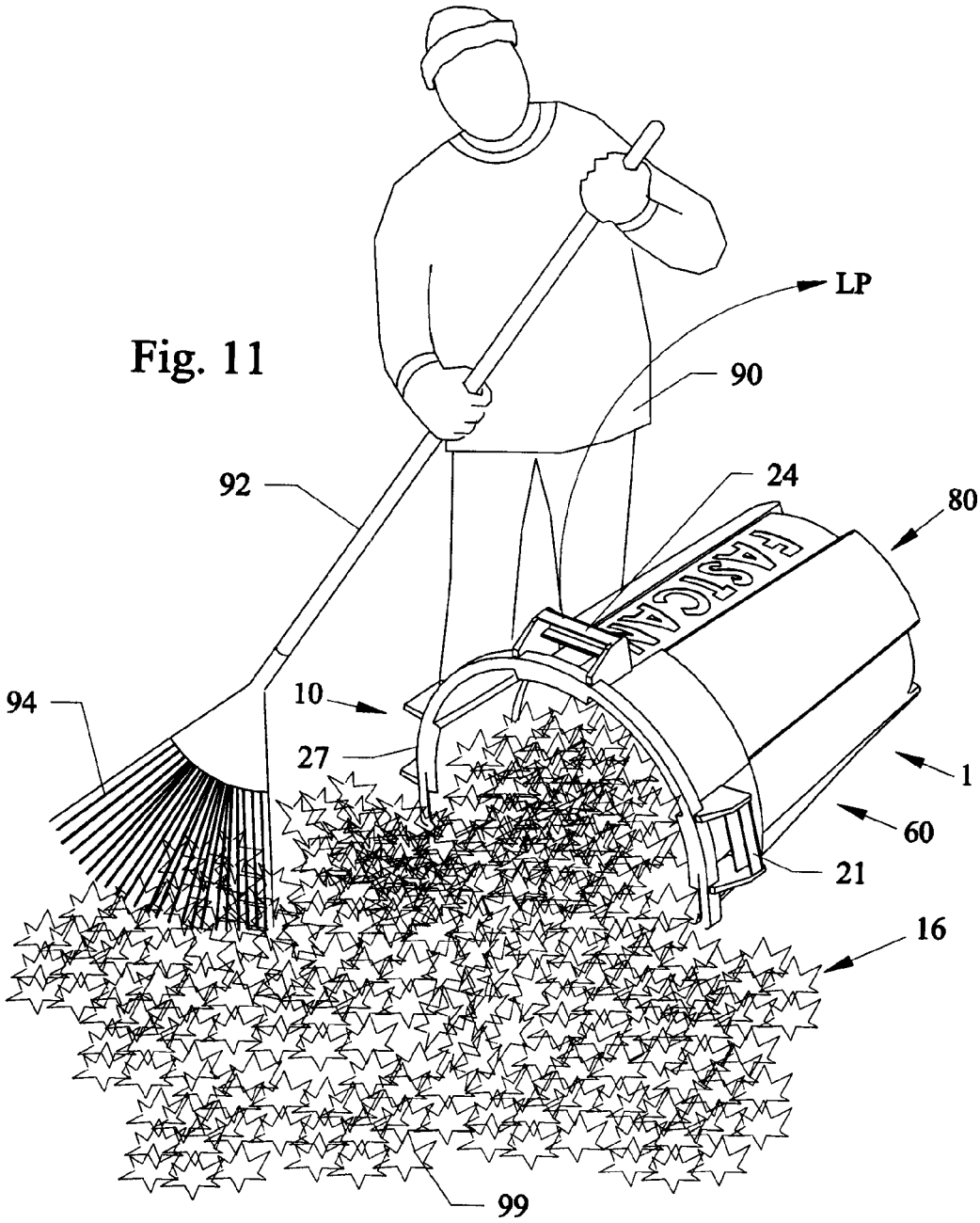
FIG. 11 shows an application of the container invention for use with landscaping

FIG. 11 shows an application of the container invention 1 of the preceding figures for use with a landscaping application. Here, a user can easily move the container 1 from a vertical upright position as previously shown by FIGS. 1, 3, 4, 6, 9 and 10 to a side orientation where the container 1 is laying on its flat side wall portion 60 by handles 21, 24, and 27. The user 90 can hold the long handle 92 of an implement such as a rake to move debris 99 into the container by the implement head 94. Here, an approximately 24 inches wide rake head 94 can easily move an entire 24 inch wide width amount of debris over the approximately 24 inch flat side edge 16 of the container into the container 1. When finished the user 90 can easily lift the container 1 by only having to pull up on top handle 24 in the direction of arrow LP without having to physically handle the sides or mouth edges of the container, and thus does not have to directly contact any of the debris that is inside the container 1.

When the novel refuse container is filled, the apex located handle 24 can be used to raise the container 1 so that the rounded side 50 can be comfortably supported over one's shoulder and back when moved. The novel shape configuration of the container that includes the flat wall portion 60 distributes the debris and weight inside the container with the center of gravity so that the filled container 1 remains both steady and stable when held by one hand over one's shoulder and back, and still remains comfortable by the curved side resting against the shoulders and back of the user.

Figure 12:
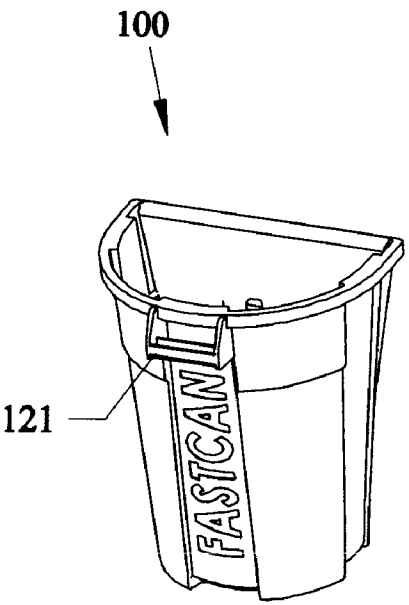
FIG. 12 is a perspective view of a 7 gallon container embodiment of the invention.

FIG. 12 is a perspective view of another embodiment 100 of the invention wherein an approximately 7 gallon container can include the novel features of the invention previously described. Here, the container 100 can be used indoors and only need one handle 122 along the apex portion of D-shaped mouth portion of the container 100 for allowing the container to be laid on its side, raised and lifted as needed.

Figure 13:
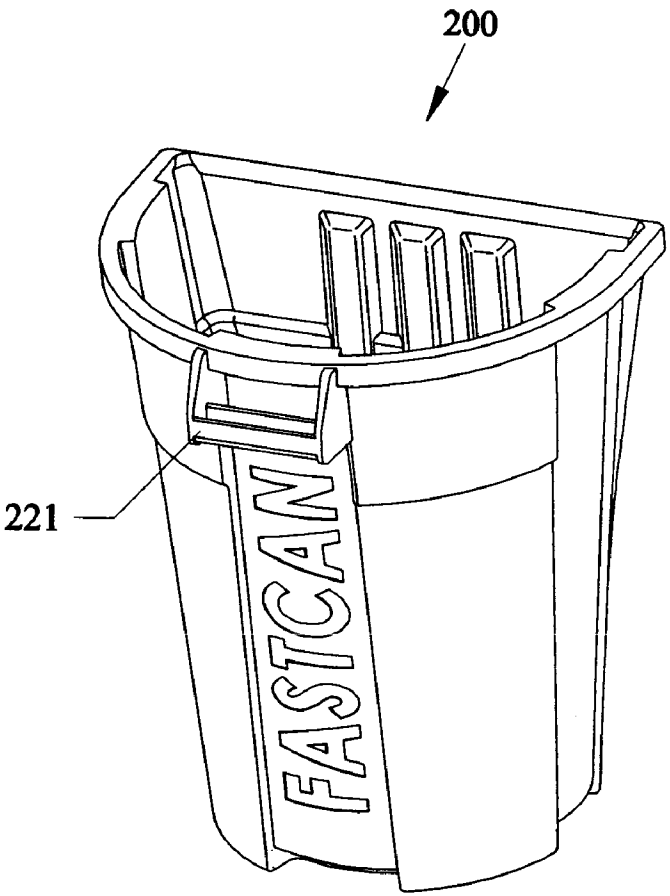
FIG. 13 is a perspective view of a 13 gallon container embodiment of the invention.

FIG. 13 is a perspective view of another embodiment 200 of the invention where an approximately 13 gallon container can include the novel features of the invention previously described. Here, the container can also be used indoors and only need one handle 222 along the apex portion of the D-shaped mouth portion of the container 200 for allowing the container to be laid on its side, raised, and lifted as needed.

Figure 15:
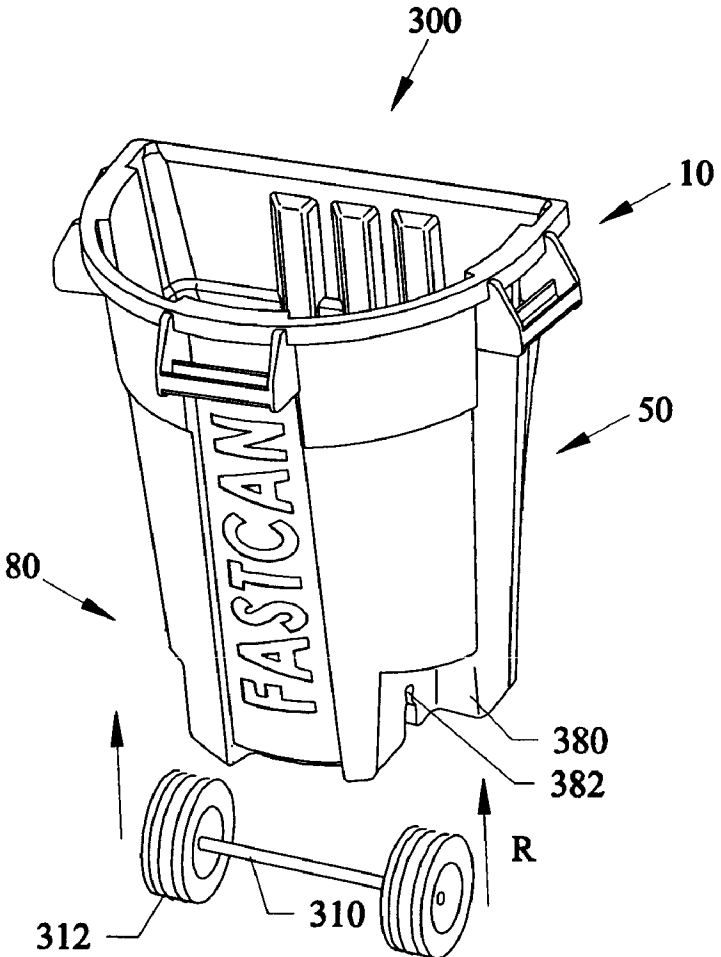
FIG. 15 is an exploded view of the wheels detached from the container of FIG. 14.
Figure 14:
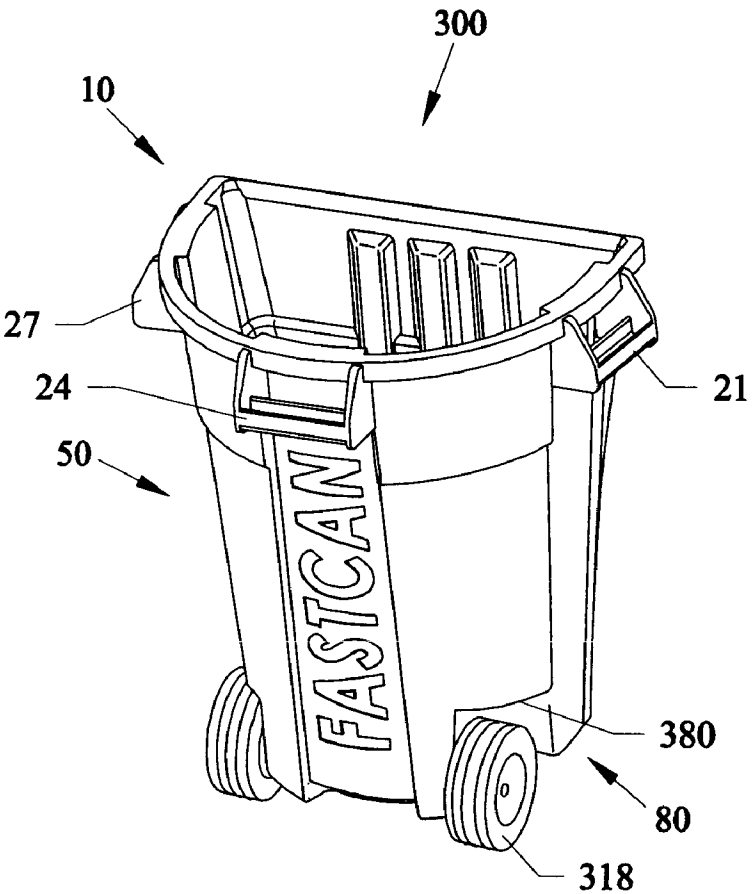
FIG. 14 is a perspective view of a wheeled container embodiment of the invention.
Figures 16, 17, 17A:
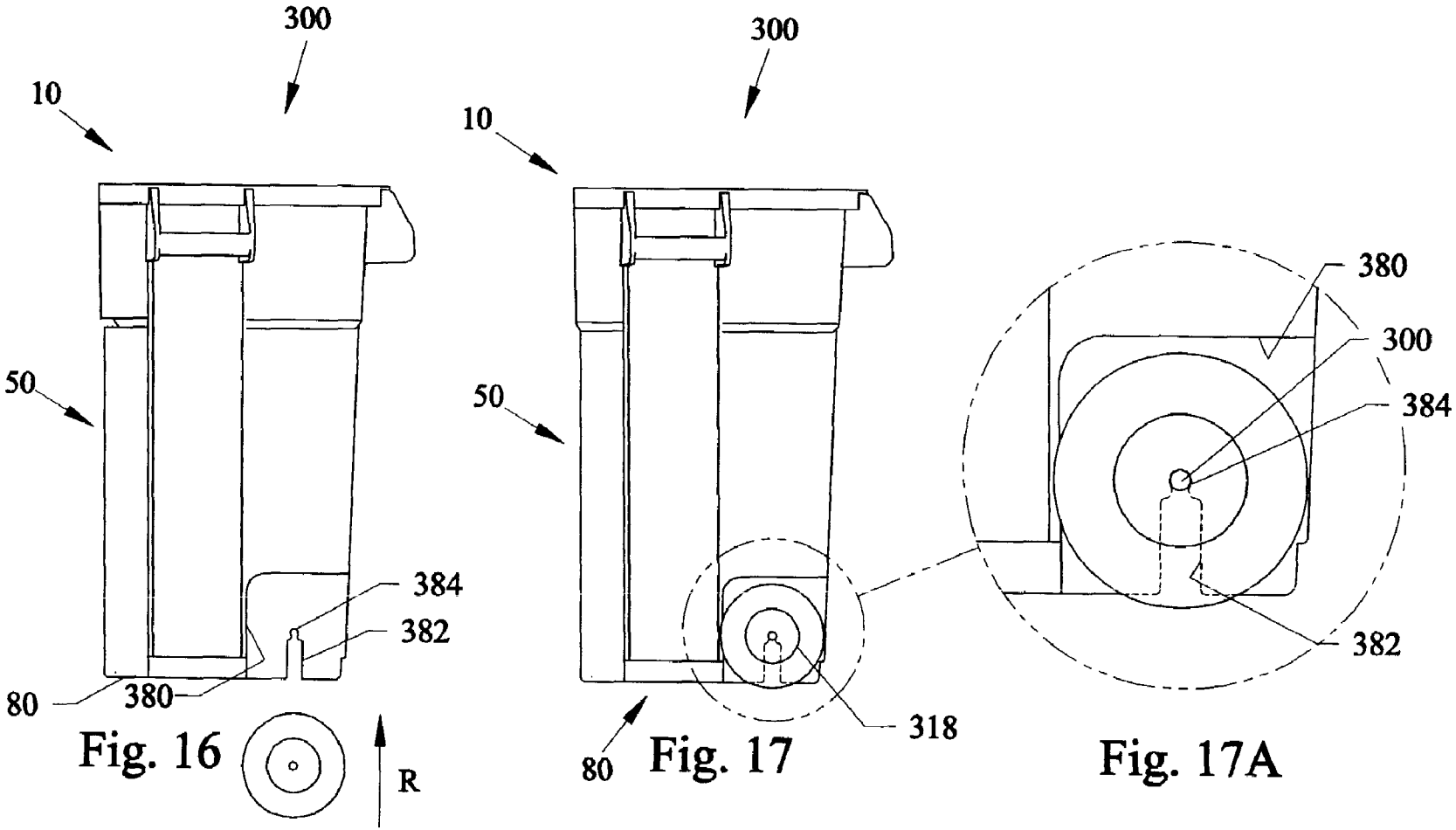
FIG. 16 is a side view of the container and wheels of FIG. 15.
FIG. 17 is a side view of the wheeled embodiment of FIG. 14.
FIG. 17A is an enlarged view of the wheels attached to the container of FIG. 17.
Figure 18:
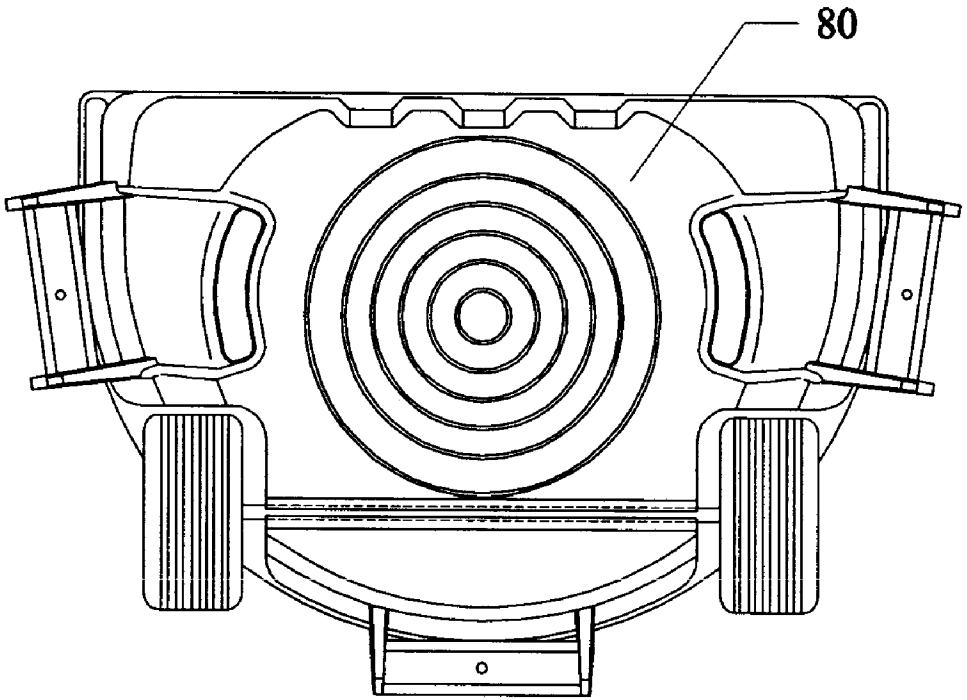
FIG. 18 is a bottom view of the wheeled container of FIGS. 14-17A.

FIG. 14 is a perspective view of a wheeled container embodiment 300 of the invention which can have similar features 10, 50 and 80 to the previous embodiments described above. FIG. 15 is an exploded view of the wheels 312, 318 detached from the container 300 of FIG. 14. FIG. 16 is a side view of the container 300 and wheels 312, 318 of FIG. 15. FIG. 17 is a side view of the wheeled embodiment 300 of FIG. 14. FIG. 17A is an enlarged view of the wheels 312, 318 attached to the container 300 of FIG. 17. FIG. 18 is a bottom view of the wheeled container 300 of FIGS. 14-17A. Referring to FIGS. 14-17A, an axle 310 having wheels 312, 318 connected to the axle 310 can be attached to the bottom end 80 of the container 300 by being moved upward in the direction of arrow R so that the axle 310 slides into a groove 382 and keyhole notch 384 which can snapably hold the axle 310 in place. Indented portions 380 in the bottom 80 of the container 1 can function as wheel wells so that the wheels 312, 318 can be positioned close to under the container 300. The container 300 can be tilted backward by at least handle 24 so that the container can ride over a ground surface by wheels 312, 318 allowing a container 300 that is filled with debris to be easily mobile when needed. The wheels 312, 318 can also be removed from the container 300 by pulling the wheels downward in the an opposite direction to that of arrow R allowing the axle 310 to snap out of the notch 384 so that the container can also be used without any wheels.

Figure 20:
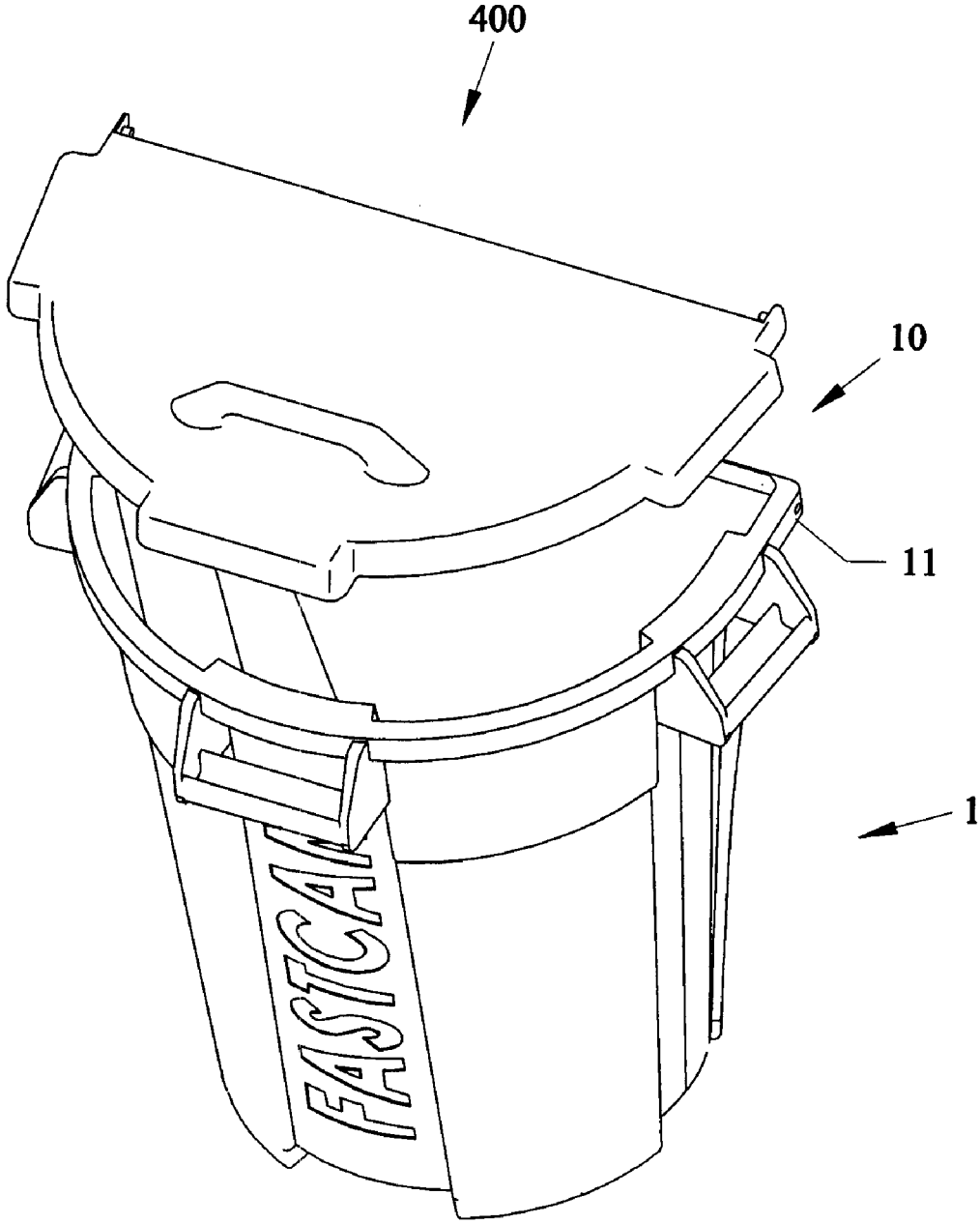
FIG. 20 is a perspective view of the novel lid of FIGS. 19A-19B being attached to the novel container of the preceding embodiments.
Figure 21B:
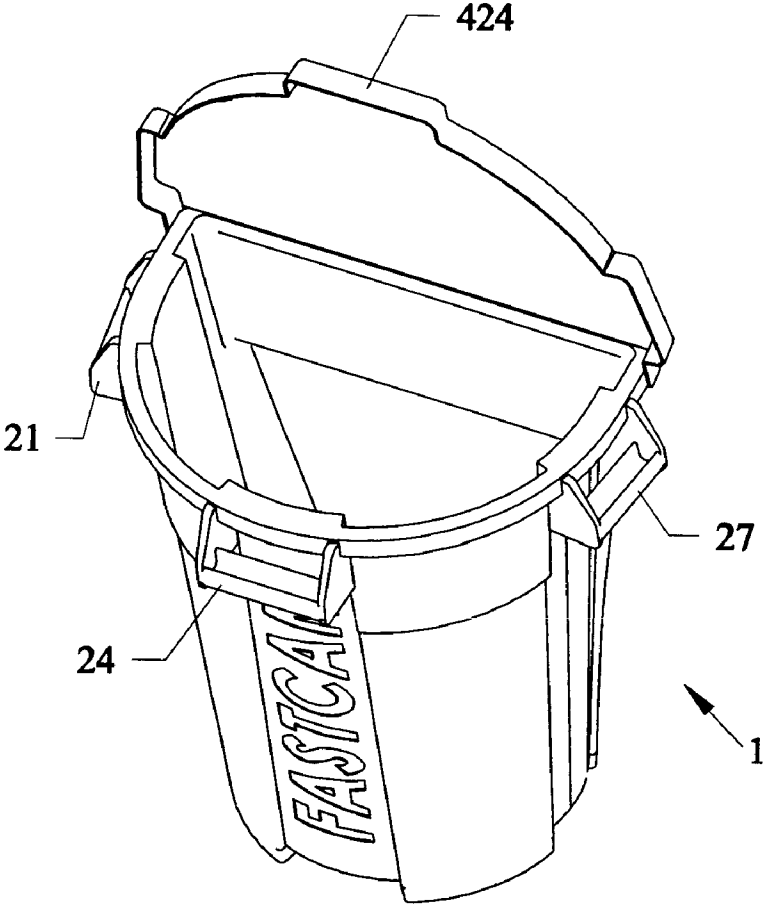
FIG. 21B is another view of FIG. 20A with the hinge lid in an open position.
Figure 21A:
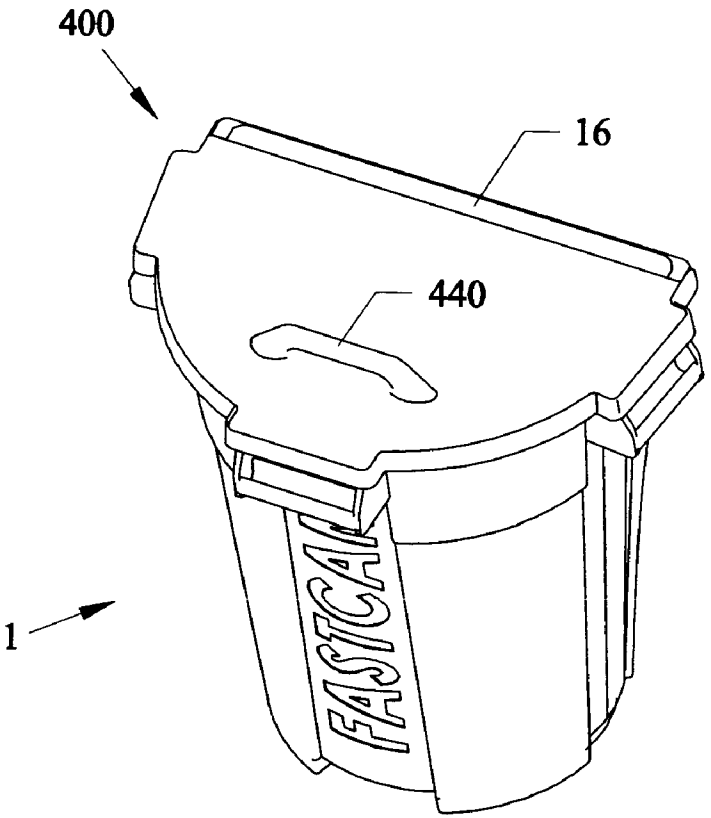
FIG. 21A is a front upper right perspective view of the hinge lid of FIGS. 19A-19B, 20 in a closed position on the novel container.

FIG. 19A is a top perspective view of a hinge lid 400 for use with the container embodiments of the preceding figures. FIG. 19B is a bottom perspective view of the hinge lid 400 of FIG. 19A. FIG. 20 is a perspective view of the novel lid 400 of FIGS. 19A-19B being attached to the novel container of the preceding embodiments. FIG. 21A is a front upper right perspective view of the hinge lid 400 of FIGS. 19A-19B, 20 in a closed position on the novel container. FIG. 21B is another view of FIG. 20A with the hinge lid 400 in an open position.

Referring to FIGS. 19A-21B, a lid 400 can be formed from injection molded plastic and have a flat top cover portion 415 having a substantially D-shape with a handle 440 molded on an upper surface adjacent to an apex portion of the D-shape. Outer extending portions 421, 424, 427 can extend out from the D-shaped edges of the lid 400 for fitting over like positioned handles 21, 24, 27 on the container 1. A curved hanging lip edge 420 on the lid 400 allows the lid 400 to cover the open mouth end 10 of the container 1. Inwardly facing protruding tips 432, 438 on opposite sides of the flat edge 410 of the lid can fit and snap into mateable holes 11 on the mouth end 10 of the container 1. Once attached, a user can raise or lower the lid 400 to open or close the open end of the container 1 by raising the handle 440 which then allows the lid to pivot to the container by hinged connection points formed by protrusions 432, 438 attached to outer edges of the mouth end 10 of the container 1.

Figure 23:
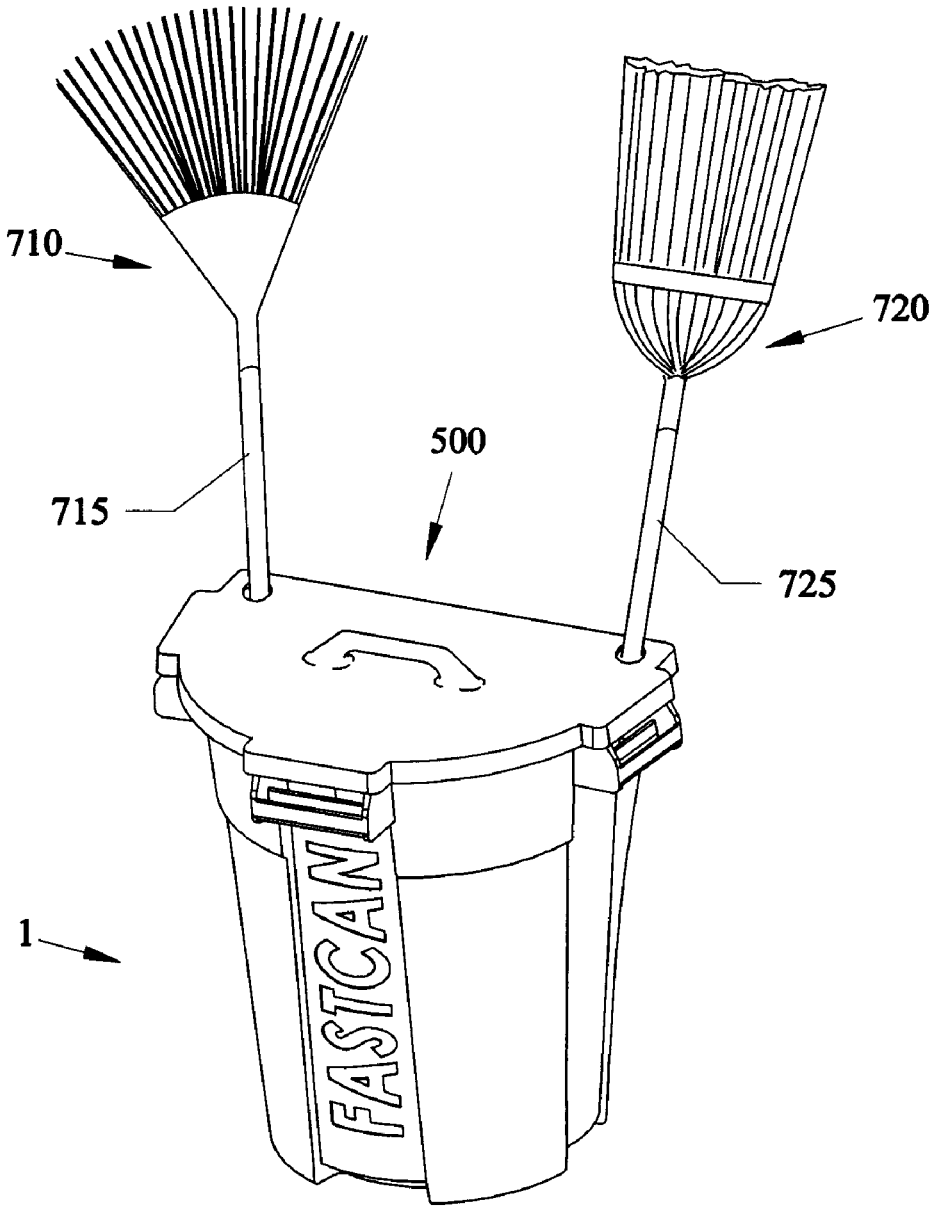
FIG. 23 is a front upper perspective view of the lid with openings of FIGS. 22A-22B in a closed position about one of the novel containers of the preceding embodiments supporting tools such as rakes and shovels.

FIG. 22A is a top perspective view of a novel snap lid 500 with openings 553, 555 for supporting the handles 715, 725 of implements 710, 720 such as brooms, rakes and shovels. FIG. 22B is a bottom perspective view of the lid 500 with openings 553, 555 of FIG. 22A. FIG. 23 is a front upper perspective view of the lid 500 with openings 553, 555 of FIGS. 22A-22B in a closed position about one of the novel containers 1 of the preceding embodiments supporting the longitudinal handles 715, 725 of tools 710, 720 such as rakes 710 and brooms 720. The lid 500 can have a substantially D-shape with a handle 540 molded on an upper surface adjacent to an apex portion of the D-shape. Outer extending portions 521, 524, 527 can extend out from the D-shaped edges of the lid 500 for fitting over like positioned handles 21, 24, 27 on the container 1. A curved hanging lip edge 520 on the lid 500 allows the lid 500 to cover the open mouth end 10 of the container 1. Inwardly facing protruding ridge portions 531, 533, 535, 537 on the inner facing surface of lip 520 of the lid 500 can allow the lid 500 to fit and snap about mateable indentations on mouth end 10 of the container 1.

Figure 24:
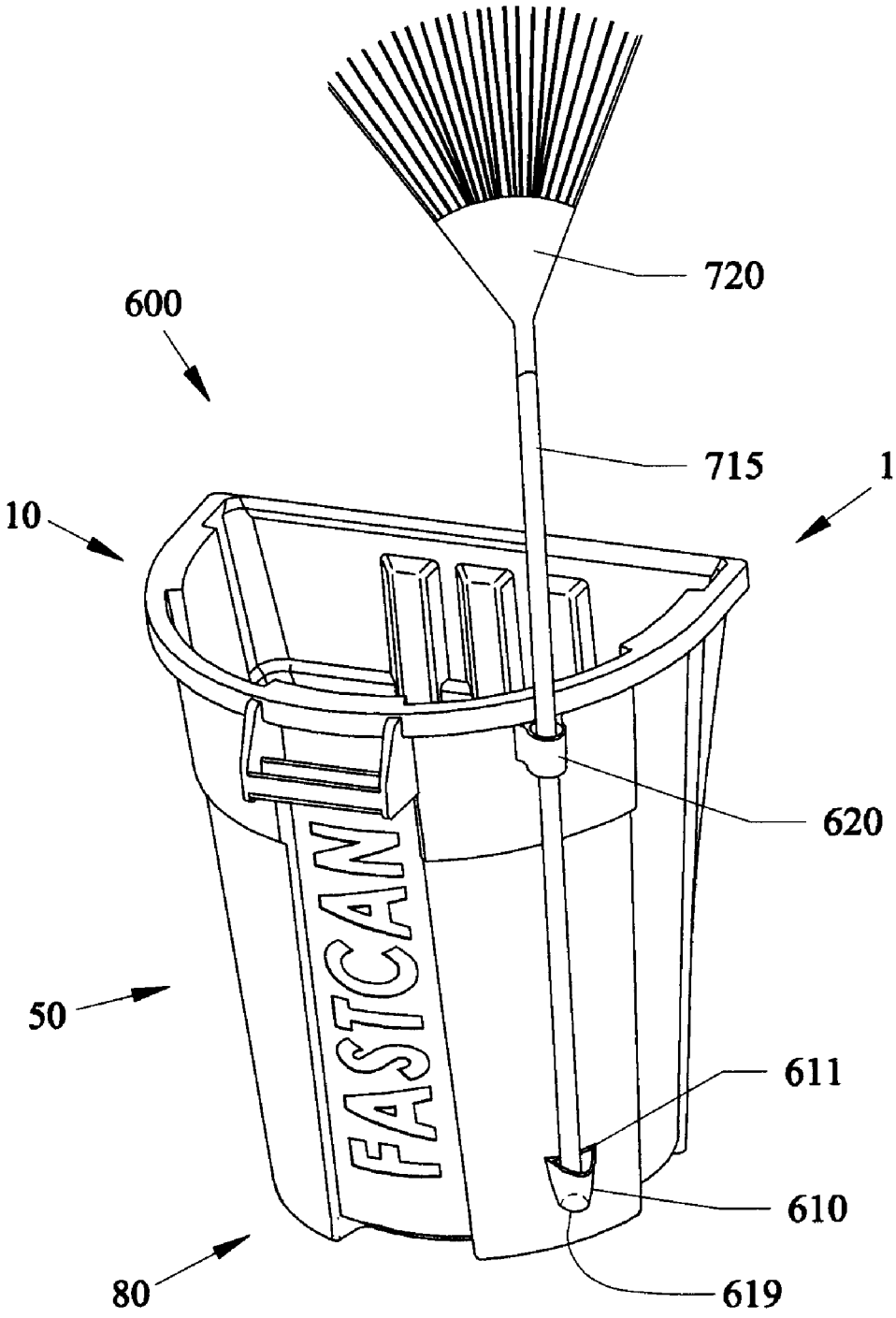
FIG. 24 is another embodiment showing molded side support members on the novel container of the preceding embodiment for supporting long handled tools such as rakes and shovels therein.

FIG. 24 is another embodiment 600 showing molded side support members 620, 610 on the novel container 1 of the preceding embodiment for supporting long handled tools 720 such a rakes, brooms and shovels therein. An upper support member 620 molded onto the side of the container 1 can have a through-hole therethrough for allowing the long handle 715 of the implement to slide therethrough. A lower support member 610 adjacent to the bottom end 80 of the container 1 can be funnel shaped with a larger top opening 611 than a bottom opening 619 so that water can drain through the holder 610 but still support and hold a tip end of a longitudinal handle 715 inside the holder 610. The holders 610 and 620 can allow for tools to be held close to and parallel to the sides of the container 1 so that users can move both the container 1 and the implements 720 together to work sites.

While long handle tools are shown being held and supported in the preceding figures, the invention can be used to hold and support smaller tools such as but not limited to hand shovels, and the like.

Although the container embodiments can be directly filled with debris, the containers can also be lined with removable plastic type garbage bags that can be separately removed as desired from the containers.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A refuse container, comprising:

a generally semi-tubular container formed from molded plastic having a closed bottom end having a substantially circular configuration and an open end having a substantially D-shaped configuration, the container having rounded side walls with a non-rectangular shaped flat side wall portion on a rear surface of the container, the flat side wall portion having a wide base portion adjacent an upper flat edge at the open end with inwardly curving convex sides which ends adjacent a bottom flat edge at the closed bottom end of the container; and a top handle molded at an apex portion of the D-shaped open end located substantially midway from the non-rectangular shaped flat side wall portion, the handle for allowing the container to be physically moved from a standing upright position to a side oriented position with container laying on the nonrectangular flat side wall so that the container can be filled with debris, and the handle for allowing the container to be easily moved back to the standing position;

a plurality of parallel longitudinal indentations located solely in the flat side wall portion of the container running midway along the wide portion approximately adjacent to the D-shaped open end to an opposite portion midway along the bottom flat edge adjacent to the closed end of the container, the parallel longitudinal indentations for reinforcing and strengthening the container, and wherein the handle at the apex portion allows the container to be physically moved from a standing upright position to a side oriented position with the container laying on the flat side wall portion; and at least one wheel attached to the container for making the container mobile.

2. The refuse container of claim 1, further comprising:

a left handle molded adjacent to a left curved edge of the D-shaped open end;

a right handle molded adjacent to a right curved edge of the D-shaped open end, the top handle being at the apex of the D-shaped open end and being opposite to a flat lower edge of the D-shaped open end, wherein the top handle with the right handle and the left handle forms a substantially equal side triangular configuration with the top handle at the apex to the triangular configuration.

3. The refuse container of claim 1, further comprising:

an angled ramp along a flat edge portion of the open mouth end of the container for allowing debris to be easily swept into the container.

4. The refuse container of claim 3, wherein the angled ramp includes:

a straight upwardly sloping planar ramp portion.

5. The refuse container of claim 4, wherein the angled ramp further includes:

a rounded blunt tip leading to the straight upwardly sloping planar ramp portion, the rounded blunt tip being formed to help maintain shape and strength of the upper flat edge of the open end of the container.

6. The refuse container of claim 3, wherein the angled ramp includes:

an approximately 24 inch long flat edge portion for allowing an approximately 24 inch broom and an approximately 24 inch rake to be able to move and slide debris fully into the container.

7. The refuse container of claim 5, wherein the angled ramp includes:

an approximately 24 inch long flat edge portion for allowing an approximately 24 inch broom and an approximately 24 inch rake to be able to move and slide debris fully into the container.

8. The refuse container of claim 1 further including:

only non-sharp angled interior surfaces inside of the container so that debris easily slides inside of the container towards the closed bottom end.

9. The refuse container of claim 1, further comprising:

a lid having for being hingedly attached onto the open end of the container to close off the open end of the container.

10. The refuse container of claim 1, wherein the wheel includes:

at least one wheel snapably mountable to the bottom end of the container for allowing the container to be easily mobile.

11. The refuse container of claim 1, further comprising:

a holder molded onto an outer side wall of the container for allowing a handle of an implement to slide into the holder and be held in place parallel to and alongside of the container, the implement being chosen from one of: a rake, a broom, a hoe, and a shovel to be carried by the container.

12. The refuse container of claim 1, further comprising:

a removable lid on the container for closing off the container, the lid having at least one small opening for allowing a handle of an implement to slide into the opening and be held in place on top of the container, the implement being chosen from one of: a rake, a broom, a hoe, and a shovel to be carried by the container.

13. A refuse container, comprising:

a generally semi-tubular container formed from molded plastic having a closed bottom end having a substantially circular configuration and an open end having a substantially D-shaped configuration, the container having rounded side walls with a non-rectangular shaped flat side wall portion on a rear surface of the container; and a top handle molded at an apex portion of the D-shaped open end located substantially midway from the non-rectangular shaped flat side wall portion, the handle for allowing the container to be physically moved from a standing upright position to a side oriented position with container laying on the nonrectangular flat side wall so that the container can be filled with debris, and the handle for allowing the container to be easily moved back to the standing position, wherein the handle at the apex portion allows the container to be physically moved from a standing upright position to a side oriented position with the container laying on the flat side wall portion;

an angled ramp along a flat edge portion of the open mouth end of the container for allowing debris to be easily swept into the container, the angled ramp has a straight upwardly sloping planar ramp portion, and a rounded blunt tip leading to the straight upwardly sloping planar ramp portion, the rounded blunt tip being formed to help maintain shape and strength of the upper flat edge of the open end of the container, and wherein the angled ramp includes an approximately 24 inch long flat edge portion for allowing an approximately 24 inch broom and an approximately 24 inch rake to be able to move and slide debris fully into the container; and at least one wheel attached to the container for making the container mobile.

14. The container of claim 13, further comprising:

a left handle molded adjacent to a left curved edge of the D-shaped open end;

a right handle molded adjacent to a right curved edge of the D-shaped open end, the top handle being at the apex of the D-shaped open end and being opposite to a flat lower edge of the D-shaped open end, wherein the top handle with the right handle and the left handle forms a substantially equal side triangular configuration with the top handle at the apex to the triangular configuration.

15. The container of claim 14, further comprising:

a plurality of parallel longitudinal indentations located solely in the flat side wall portion of the container running midway along the wide portion approximately adjacent to the D-shaped open end to an opposite portion midway along the bottom flat edge adjacent to the closed end of the container, the parallel longitudinal indentations for reinforcing, and strengthening the container.

16. The container of claim 15, wherein the flat side wall portion having a wide base portion adjacent an upper flat edge at the open end with inwardly curving convex sides which ends adjacent a bottom flat edge at the closed bottom end of the container.

* * * * *